US008011993B1

(12) United States Patent
Thompson

(10) Patent No.: US 8,011,993 B1
(45) Date of Patent: Sep. 6, 2011

(54) DIVING TOY

(76) Inventor: William Vernon Thompson, Cupertino, CA (US)

( * ) Notice: Subject to any disclaimer, the term of this patent is extended or adjusted under 35 U.S.C. 154(b) by 368 days.

(21) Appl. No.: 12/366,229

(22) Filed: Feb. 5, 2009

Related U.S. Application Data

(60) Provisional application No. 61/047,279, filed on Apr. 23, 2008.

(51) Int. Cl.
*A63H 23/04* (2006.01)
*A63H 23/00* (2006.01)

(52) U.S. Cl. ..... 446/161; 446/153

(58) Field of Classification Search ..... 446/153–155, 446/160–165; 114/312, 338
See application file for complete search history.

(56) References Cited

U.S. PATENT DOCUMENTS

| | | | | |
|---|---|---|---|---|
| 1,180,053 | A * | 4/1916 | Lehman | 446/161 |
| 1,736,270 | A * | 11/1929 | Mackintosh | 446/161 |
| 2,243,568 | A * | 5/1941 | Middler | 446/162 |
| 2,307,304 | A | 1/1943 | Rudd | |
| 2,452,495 | A * | 10/1948 | Sabini | 446/161 |
| 2,600,309 | A | 6/1952 | MacDonald | |
| 2,749,658 | A | 6/1956 | Neumann | |
| 2,826,001 | A * | 3/1958 | Presnell | 446/161 |
| 2,990,645 | A * | 7/1961 | Polzin | 446/154 |
| 3,010,255 | A * | 11/1961 | Gordon | 446/162 |
| 3,619,938 | A * | 11/1971 | Tong | 446/161 |
| 3,935,665 | A | 2/1976 | Tong | |
| 3,952,349 | A | 4/1976 | Erath | |
| 4,025,930 | A * | 5/1977 | Wolff | 396/29 |
| 4,179,841 | A | 12/1979 | Kupperman | |
| 4,241,535 | A * | 12/1980 | Tsukuda | 446/156 |
| 4,919,637 | A | 4/1990 | Fleischmann | |
| 5,077,929 | A | 1/1992 | Khan | |
| 5,865,662 | A | 2/1999 | Dammann | |
| 5,865,663 | A | 2/1999 | Liao | |
| 6,093,076 | A | 7/2000 | Street | |
| 6,280,277 | B1 | 8/2001 | Greenberg | |
| 6,443,799 | B1 | 9/2002 | Gibson | |

FOREIGN PATENT DOCUMENTS

GB 2165766 A * 4/1986

* cited by examiner

*Primary Examiner* — Gene Kim
*Assistant Examiner* — Alyssa Hylinski

(57) ABSTRACT

A diving toy that is comprised of a housing with a motor, battery and magnetic reed switch positioned inside the housing. A propeller is attached to an axle of the motor protruding through the rear end of the housing. A ballast is arranged inside the housing to provide positive buoyancy and a front end down attitude. A plurality of fins protrude from the housing surrounding the propeller for improving directional stability. A lever having one end rotatably mounted to the outside of the housing and another end provided with a magnet. When the toy is dropped or thrown front end first into a body of water, or when pushed in a downward motion from a submerged state, hydrodynamic forces rotate and then hold the lever and accordingly the magnet in a rearward position so long as there is downward motion, aligning the magnet adjacent to the reed switch, thereby actuating the reed switch to close a circuit between the battery and motor activating the motor, and forces generated by the spin of the propeller overcome the toys positive buoyancy propelling the toy in a continuous dive until it collides with a bottom of the body of water or another object stopping the dive, whereby gravity rotates the lever and magnet forward away from the reed switch to shut off the motor, the positive buoyant toy then floats to a surface of the body of water where it can be launched into another dive.

18 Claims, 2 Drawing Sheets

DIVING TOY

CROSS-REFERENCE TO RELATED APPLICATIONS

This application claims the benefit of provisional patent application Ser. No. 61/047,279, filed 2008 Apr. 23 by the present inventor.

FEDERALLY SPONSORED RESEARCH

Not Applicable

SEQUENCE LISTING OR PROGRAM

Not Applicable

BACKGROUND

1. Field of the Invention

This invention relates generally to motorized swimming toys.

2. Prior Art

Motorized swimming toys are generally limited to movements along the surface of the water. Although some toy submarines can dive they require sophisticated diving controls that make them relatively large and expensive. They are also limited to slow and boring motions. Many motorized swimming toys provide an automatic underwater movement that is more or less independent of the active participation of the user, it will often turn out that these toys after some time will provide less motivation for active play.

SUMMARY

A diving toy that is comprised of a housing with a motor, battery and magnetic reed switch positioned inside the housing. A propeller is attached to an axle of the motor protruding through the rear end of the housing. A ballast is arranged inside the housing to provide positive buoyancy and a front end down attitude. A plurality of fins protrude from the housing surrounding the propeller for improving directional stability. A lever having one end rotatably mounted to the outside of the housing and another end provided with a magnet. When the toy is dropped or thrown front end first into a body of water, or when pushed in a downward motion from a submerged state, hydrodynamic forces rotate and then hold the lever and accordingly the magnet in a rearward position so long as there is downward motion, aligning the magnet adjacent to the reed switch, thereby actuating the reed switch to close a circuit between the battery and motor activating the motor, and forces generated by the spin of the propeller overcome the toys positive buoyancy propelling the toy in a continuous dive until it collides with a bottom of the body of water or another object stopping the dive, whereby gravity rotates the lever and magnet forward away from the reed switch to shut off the motor, the positive buoyant toy then floats to a surface of the body of water where it can be launched into another dive.

DRAWING

Figures

DRAWINGS

Reference Numerals

10. Housing
11. Front Portion
12. Rear Portion
13. Fins
14. Front End
15. Rear End
16. Magnet
17. Lever
18. Hinge
19. Axle
20. Motor
21. Magnetic Reed Switch
22. Battery
23. Ballast
24. Clip
25. Electric wire connecting battery to motor
26. Electric wire connecting battery to magnetic reed switch
27. Electric wire connecting magnetic reed switch to motor
28. Drag Fin
29. Longitudinal Axis
30. Propeller

DETAILED DESCRIPTION OF THE INVENTION

Figure 1:
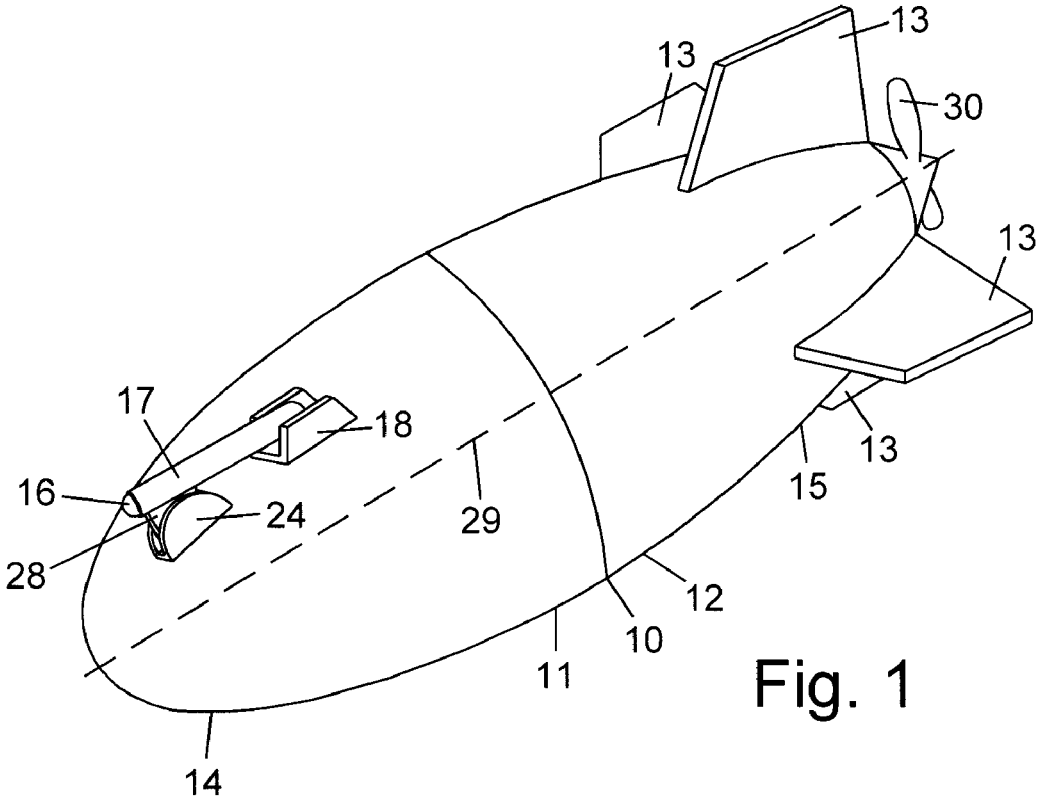
FIG. 1 is a perspective view of a diving toy constructed in accordance with the invention. The lever is in its full forward or off position.

FIG. 1 is a perspective view of a diving toy constructed in accordance with the invention. It is comprised of housing 10 with propeller 30 attached to rear end 15 along longitudinal axis 29. Housing 10 is water proof and streamlined for maximum drag reduction. Four fins 13 protrude from rear end 15 to improve directional stability. Front portion 11 and rear portion 12 are detachable. Hinge 18 is disposed outside of front portion 11 of housing 10. Clip 24 is disposed forward of and aligned with hinge 18 outside of front portion 11 of housing 10. One end of lever 17 is rotatably mounted to hinge 18 and another end of lever 17 is provided with magnet 16 and drag fin 28. Drag fin 28 is shown frictional held in clip 24, thereby holding lever 17 in its full forward or off position, thus preventing the toy from activating while not in use.

Figure 2:
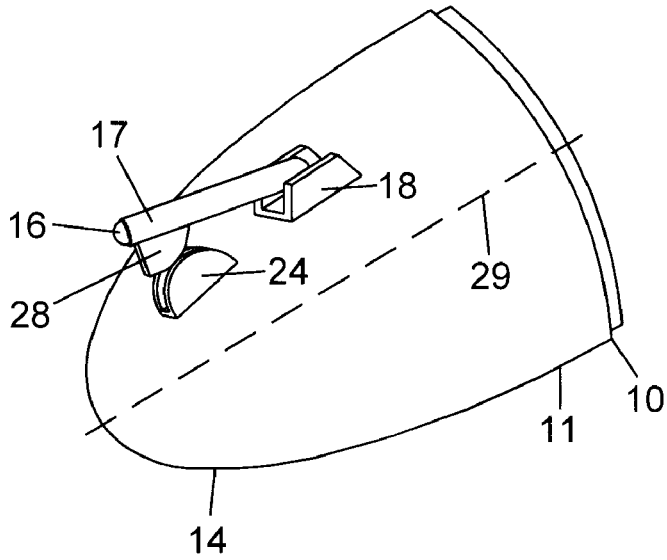
FIG. 2 is a perspective view of the front portion of the diving toy. The lever is in its forward ready or launch position.

FIG. 2 is a perspective view of front portion 11 of housing 10. Lever 17 is shown in its forward ready or launch position. Drag fin 28 rest against clip 24 positioning the end of lever 17 that is provided with magnet 16 and drag fin 28 outside hinge 18 relative to axis 29 to increase the angle of attack of lever 17 relative to the flow of water moving rearwardly over housing 10 when the toy is launched into a dive, thereby permitting hydrodynamic forces to rotate lever 17 rearward about hinge 18.

Figure 3:
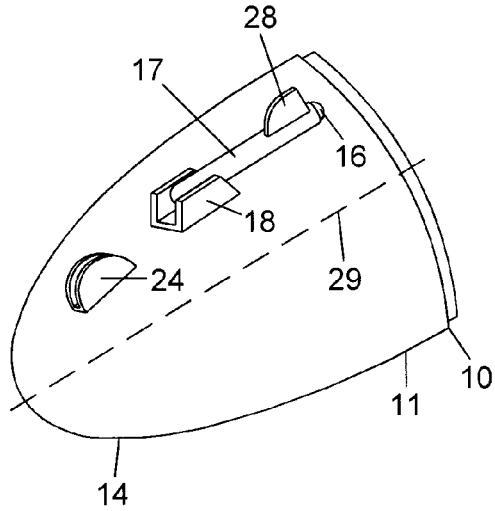
FIG. 3 is a perspective view of the front portion of the diving toy. The lever is in its full rearward or running position.

FIG. 3 is a perspective view of front portion 11 of housing 10. Hydrodynamic forces act on lever 17 and drag fin 28 to hold lever 17 in the full rearward or running position shown while the toy is diving. The center of gravity of lever 17 is positioned outside hinge 18 relative to axis 29, thereby permitting gravity to rotate lever 17 forward about hinge 18 when the toy collides with an object stopping a dive.

Figure 4:
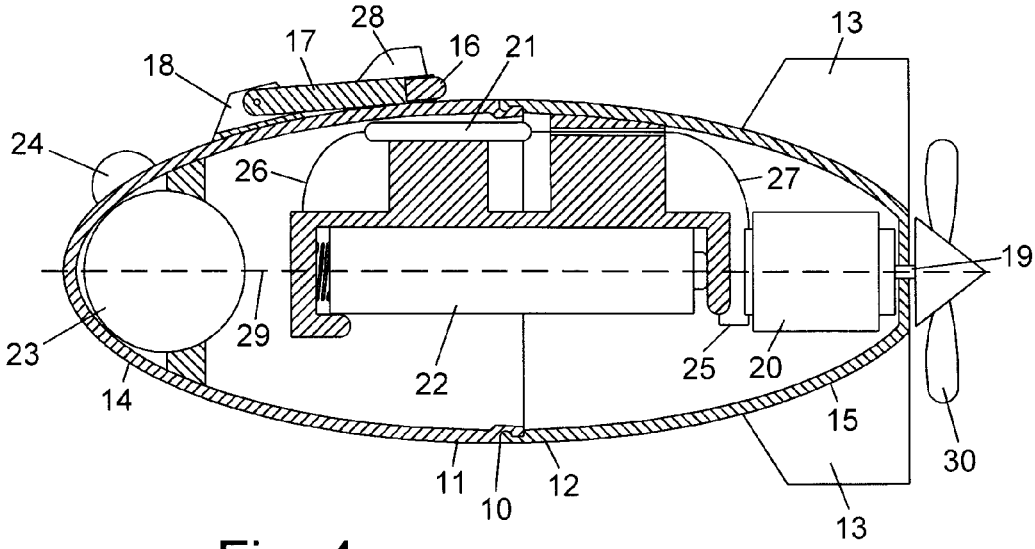
FIG. 4 is a side sectional view of the diving toy. The lever is in its full rearward or running position.

FIG. 4 is a side sectional view of the diving toy. Battery 22 is connected to motor 20 and magnetic reed switch 21 with electric wires 25 and 26 respectively. Magnetic reed switch 21 is connected to motor 20 with electric wire 27. Ballast 23 is arranged to provide a positive buoyancy with front end 14 pointed down and rear end 15 pointed up, that is, the toys longitudinal axis 29 will be perpendicular to the horizontal plane when the toy is placed in water. Lever 17 is shown in its full rearward or running position. Propeller 30 is attached to an axle 19 of motor 20 protruding through housing 10 such that when motor 20 is activated, the propeller 30 spins.

Operation

With drag fin 28 removed from clip 24 and lever 17 in its forward ready or launch position (FIG. 2) the diving toy is dropped or thrown front end first into a body of water, or pushed in a downward motion from a submerged state, hydrodynamic forces acting on drag fin 28 and lever 17 cause lever 17 and accordingly magnet 16 to be rotated and then held rearward (FIGS. 3 and 4) so long as there is downward motion, aligning magnet 16 adjacent to magnetic reed switch 21 (FIG. 4), thereby actuating reed switch 21 to close a circuit between battery 22 and motor 20 activating motor 20. Forces generated by the spin of propeller 30 (FIGS. 1 and 4) overcome the toys positive buoyancy propelling the toy in a continuous dive until it collides with a bottom of the body of water or another object stopping the dive, whereby gravity rotates lever 17 and magnet 16 forward (FIG. 2) away from reed switch 21 to shut off motor 20. The positive buoyant toy then floats to a surface of the body of water where it can be launched into another dive.

CONCLUSION, RAMIFICATION, AND SCOPE

Having described one specific embodiment of my invention, it is not desired to limit the invention to the exact construction and operation shown and described. The forgoing is considered as illustrative only of the principles of the invention, it is obvious that many modifications and variations of the present invention are possible. For example, alternatively reed switch 21 may be another type of switch which may be mechanically actuated by lever 17 to close and open a circuit between battery 22 and motor 20. Also, lever 17 may be placed in various locations outside housing 10, or in a tunnel which may be added to allow water to flow through housing 10, with the location of reed switch 21 changing accordingly. Instead of lever 17 and reed switch 21 it is also possible that motor 20 can be controlled by a sensor that detects stimuli like the forward motion of the toy in water to close and open a circuit between battery 22 and motor 20 and another arrangement for preventing the toy from activating while not in use may be provided. It is therefore to be understood that all suitable modification and equivalents may be resorted to, falling within the scope of the invention.

I claim:

1. A diving toy, comprising:

(a) a housing having a predetermined orientation and positive buoyancy when placed in water;

(b) an electric motor in said housing;

(c) a propeller attached to said motor;

(d) a control system comprising a flow sensor means positioned outside said housing for sensing water flowing rearwardly over said housing at a predetermined velocity, and a switch means responsive to said flow sensor means, said switch means being constructed and arranged for switching on/off said motor under certain conditions;

(e) a battery in said housing to power said motor and the control system;

whereby when said diving toy is dropped or thrown into a body of water, or when pushed in a downward motion from a submerged state, hydrodynamic forces cause said flow sensor means to actuate said switch means to close a circuit between said battery and motor, thereby causing said motor to run and propel said toy in a dive; and when said dive and hydrodynamic forces stop because said toy collides with a bottom of said body of water or another object, said flow sensor means causes said switch means to open said circuit, thereby turning off said motor, causing said toy to float to a surface of said body of water.

2. The diving toy of claim 1, wherein said housing is elongated with a stream lined shape and well defined forward movement direction shaped extremities for reduced drag.

3. The diving toy of claim 1, further including a ballast inside said housing for adjusting balance and said positive buoyancy.

4. The diving toy of claim 1, further including a plurality of fins protruding from said housing surrounding said propeller for improving directional stability.

5. The diving toy of claim 1, wherein said switch means is a magnetically actuated switch, and wherein said flow sensor means comprises magnetic means with moveably mounting means for movement between a first position and a second position; whereby when said diving toy is dropped or thrown into a body of water, or when pushed in a downward motion from a submerged state, hydrodynamic forces move and then hold said moveable mounting means and accordingly said magnetic means to a second position actuating said switch to close a circuit between said battery and motor, thereby causing said motor to run and propel said toy in a dive; and when said dive and hydrodynamic forces stop because said toy collides with a bottom of said body of water or another object, said moveably mounting means and magnetic means move to a first position due to gravity which causes said switch to open said circuit, thereby turning off said motor, causing said toy to float to a surface of said body of water.

6. The diving toy of claim 5, wherein said switch comprises a reed switch placed inside said housing.

7. The diving toy of claim 5, wherein said magnetic means is a magnet, and wherein said moveably mounting means comprises a lever having one end rotatably mounted to the outside of said housing and another end provided with said magnet; whereby when water flows rearwardly over said housing at a predetermined velocity, hydrodynamic forces rotate and then hold said lever and accordingly said magnet rearward, and when said water flow stops, said lever and magnet rotate to a forward position due to gravity.

8. The diving toy of claim 7, further including means for retaining said lever in a predetermined off position while said diving toy is not in use.

9. The diving toy of claim 7, further including means for increasing the hydrodynamic drag of said lever as it moves through water so as to enable hydrodynamic forces to more easily rotate and hold said lever rearward.

10. A diving toy, comprising:

(a) a housing having a predetermined orientation and positive buoyancy when placed in water;

(b) an electric motor in said housing;

(c) a propeller attached to said motor;

(d) a control system comprising a magnetic reed switch placed inside said housing constructed and arranged for switching on/off said motor, and a lever having one end rotatably mounted to the outside of said housing and another end provided with a magnet for actuating said switch under certain conditions;

(e) a battery in said housing to power said motor and the control system;

whereby when said diving toy is dropped or thrown into a body of water, or when pushed in a downward motion from a submerged state, hydrodynamic forces rotate and then hold said lever and accordingly said magnet rearward actuating said switch to close a circuit between said battery and motor, thereby causing said motor to run and propel said toy in a dive; and when said dive and hydrodynamic forces stop because said toy collides with a bottom of said body of water or another object, said lever and magnet rotate to a forward position due to gravity which causes said switch to open said circuit, thereby turning off said motor, causing said toy to float to a surface of said body of water.

11. The diving toy of claim 10, wherein said housing is elongated with a stream lined shape and well defined forward movement direction shaped extremities for reduced drag.

12. The diving toy of claim 10, further including a ballast inside said housing for adjusting balance and said positive buoyancy.

13. The diving toy of claim 10, further including a plurality of fins protruding from said housing surrounding said propeller for improving directional stability.

14. The diving toy of claim 10, further including means for retaining said lever in a predetermined off position while said diving toy is not in use.

15. The diving toy of claim 10, further including means for increasing the hydrodynamic drag of said lever as it moves through water so as to enable hydrodynamic forces to more easily rotate and hold said lever rearward.

16. A diving toy, comprising:

(a) a housing having a predetermined orientation and positive buoyancy when placed in water, wherein said housing is elongated with a stream lined shape and well defined forward movement direction shaped extremities for reduced drag;

(b) an electric motor in said housing;

(c) a propeller attached to said motor;

(d) a control system comprising a magnetic reed switch placed inside said housing constructed and arranged for switching on/off said motor, and a lever having one end rotatably mounted to the outside of said housing and another end provided with a magnet for actuating said switch under certain conditions;

(e) a battery in said housing to power said motor and the control system;

(f) a ballast inside said housing for adjusting balance and said positive buoyancy;

(g) a plurality of fins protruding from said housing surrounding said propeller for improving directional stability;

whereby when said diving toy is dropped or thrown into a body of water, or when pushed in a downward motion from a submerged state, hydrodynamic forces rotate and then hold said lever and accordingly said magnet rearward actuating said switch to close a circuit between said battery and motor, thereby causing said motor to run and propel said toy in a dive; and when said dive and hydrodynamic forces stop because said toy collides with a bottom of said body of water or another object, said lever and magnet rotate to a forward position due to gravity which causes said switch to open said circuit, thereby turning off said motor, causing said toy to float to a surface of said body of water.

17. The diving toy of claim 16, further including means for retaining said lever in a predetermined off position while said diving toy is not in use.

18. The diving toy of claim 16, further including means for increasing the hydrodynamic drag of said lever as it moves through water so as to enable hydrodynamic forces to more easily rotate and hold said lever rearward.

* * * * *